US005632237A

United States Patent [19]

Cornell et al.

[11] Patent Number: 5,632,237

[45] Date of Patent: May 27, 1997

[54] HYDRAULIC LASH COMPENSATING ELEMENT ASSEMBLY

[75] Inventors: Richard D. Cornell, Muskegon; Robert C. Roos, Fruitport, both of Mich.

[73] Assignee: Hy-Lift Division of SPX Corporation, Muskegon, Mich.

[21] Appl. No.: 511,953

[22] Filed: Aug. 7, 1995

[51] Int. Cl.[6] ..... F01L 1/24

[52] U.S. Cl. ..... 123/90.46; 123/90.55

[58] Field of Search ..... 123/90.39, 90.45, 123/90.46, 90.48, 90.49, 90.52, 90.55

[56] References Cited

U.S. PATENT DOCUMENTS

| | | | |
|---|---|---|---|
| 2,036,936 | 4/1936 | Halford | 123/90.46 |
| 3,008,687 | 11/1961 | Tauschek et al. | 123/90.67 |
| 4,502,428 | 3/1985 | Paar | 123/90.46 |
| 4,570,582 | 2/1986 | Speil | 123/90.46 |
| 4,708,103 | 11/1987 | Speil | 123/90.46 |
| 4,815,424 | 3/1989 | Buuck et al. | 123/90.46 |
| 4,856,468 | 8/1989 | Speil et al. | 123/90.46 |

*Primary Examiner*—Weilun Lo

*Attorney, Agent, or Firm*—Barnes, Kisselle, Raisch, Choate, Whittemore & Hulbert, P.C.

[57] ABSTRACT

A hydraulic lash element compensating assembly mounted in the valve end of a rocker arm or other valve actuating device. The hydraulic last compensating element compensates for any clearance in the engine valve train due to wear and due to thermal expansion. The element includes a self adjusting hydraulic assembly with a cylindrical outer housing having a spherical protrusion on the end facing the valve. A foot is retained by a retainer permanently fixed to the swivel foot and securely attaching the foot to the housing, but allowing angular and rotational movement of the swivel foot relative to the spherical protrusion on the housing. The retainer may be constructed from a thermoplastic material by injection molding or from sheet steel by stamping.

8 Claims, 6 Drawing Sheets

VALVE CLOSED

VALVE OPEN

VALVE OPEN

HYDRAULIC LASH COMPENSATING ELEMENT ASSEMBLY

This invention relates to valve systems for automotive vehicles and particularly to hydraulic lash element assemblies.

BACKGROUND OF THE INVENTION

In valve systems for automotive vehicles, it is common to provide a hydraulic lash compensating element which is installed in a rocker arm, for example, as shown in U.S. Pat. No. 2,036,936. In such a construction, a foot section with a spherical cavity contacts a spherical protrusion of the lash element housing. This translates the relative axial movement of the push rod into the rotational movement of the rocker arm. In this patent, the foot section is secured by pressing a cylindrical section of the foot into a cavity in the push rod. (FIG. 1)

In some designs no separate foot section is used and the spherical end of the lash element housing is in direct contact with the engine valve. This is shown in U.S. Pat. No. 4,502,428. Such a design may have excessive contact stress between the lash element and the valve. (FIG. 2)

In other designs, the foot section has no external retaining device. It is simply held in place by valve spring preload pressure. Assembly of the rocker arm and lash element into the engine is very difficult with this type of design. In addition, this also forces the engine manufacture to inventory additional components. See U.S. Pat. No. 4,708,103 (FIG. 2).

In other designs the foot is attached to the valve stem. A flange on the foot engages a groove on the valve stem as shown in U.S. Pat. No. 4,570,582. This approach requires additional machining of the valve stem. (FIG. 4)

In another method described in U.S. Pat. No. 4,708,103, a retainer is attached to the lash element housing. It is roughly cylindrical in shape and has an inward flange on one end for retaining of the foot section but allowing relative rotation of the foot to the spherical protrusion of the housing.

Among the objectives of the present invention are to provide a hydraulic lash compensating element assembly which overcomes the deficiencies in the art; which minimizes stress between the lash element and the valve; which is easier to assemble; which reduces the inventory of component parts; which requires less machining; and which results in greater efficiency of the engine valve train.

SUMMARY OF THE INVENTION

A hydraulic lash compensation element assembly is installed into a cylindrical cavity in a rocker arm. The assembled rocker arm is used in the valve train of an internal combustion engine to translate the rotational movement of the camshaft into axial movement of the engine valve. The hydraulic element is designed to automatically eliminate any clearance in the valve train. The outer housing of the hydraulic lash adjuster has a spherical protrusion. This protrusion contacts a swivel foot. The swivel foot has a substantially spherical cavity on one end which contacts the spherical protrusion of the hydraulic element housing, and a flat surface on the other end which contacts the engine valve. This swivel foot allows for the relative angular motion between the center lines of the valve and the hydraulic lash element during valve opening and closing. The swivel foot is held in place using a new and unique retainer. This retainer is roughly cylindrical in shape and is permanently attached to the swivel foot by pressing a reduced diameter of the retainer over a flange on the swivel foot. This reduced diameter may extend over all or a portion of the circumference. This retainer also has a reduced diameter annular base flange on the other end which engages a groove on the lash adjuster housing beyond the spherical protrusion. In another embodiment of the invention, the reduced diameter engaging the element housing may be offset from the center line of the retainer. In another option the reduced diameter which is pressed over the flange on the pivot foot, may be replaced by a plurality of indentations.

DESCRIPTION OF THE PREFERRED EMBODIMENT

Figure 1:
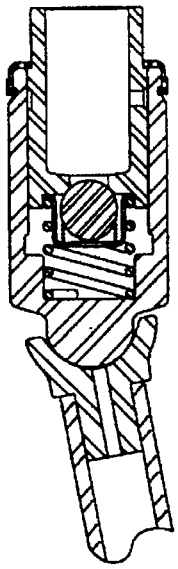
FIG.1 PRIOR ART
FIG. 1 is a sectional view of a construction shown in prior art U.S. Pat. No. 2,036,936.
Figure 2:
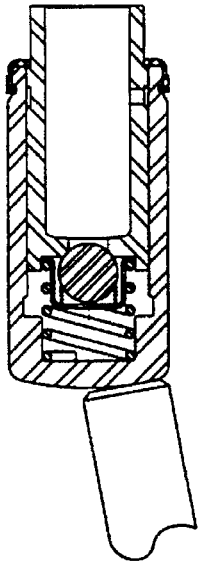
FIG.2 PRIOR ART
FIG. 2 is a sectional view of a construction shown in prior art U.S. Pat. No. 4,502,428.
Figure 3:
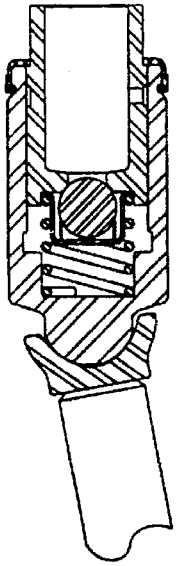
FIG 3 PRIOR ART
FIG. 3 is a sectional view of a construction shown in prior art U.S. Pat. No. 4,708,103.
Figure 4:
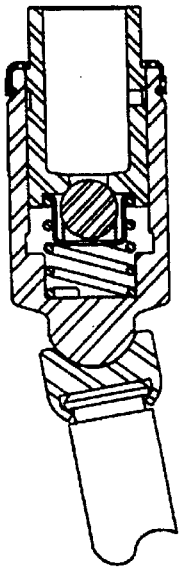
FIG.4 PRIOR ART
FIG. 4 is a sectional view of a construction shown in prior art U.S. Pat. No. 4,570,582.
Figure 5:
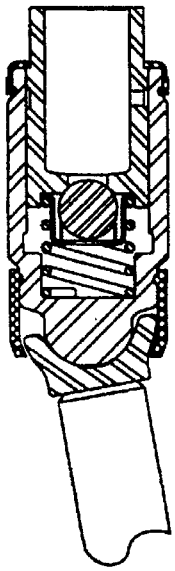
FIG.5 PRIOR ART
FIG. 5 is a sectional view of another form shown in prior art U.S. Pat. No. 4,708,103.

Referring to FIGS. 6–13, a hydraulic lash compensating element assembly 20 is provided in an end 22 of a rocker arm 24 which is pivoted on a shaft 26 and has a roller 28 on a short arm 30 which engages a cam 32 on a cam shaft 34. The hydraulic lash compensating assembly 20 engages the free end 36 of a valve 38 in a manner well known in the art to move the valve and also eliminate clearance in the valve train.

Figure 6:
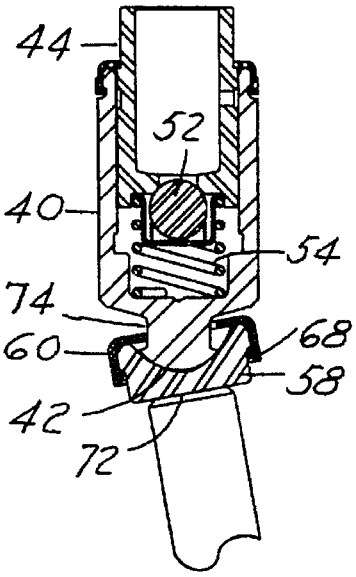
FIG. 6 is a fragmentary sectional view of a hydraulic lash element embodying the invention.
Figure 9:
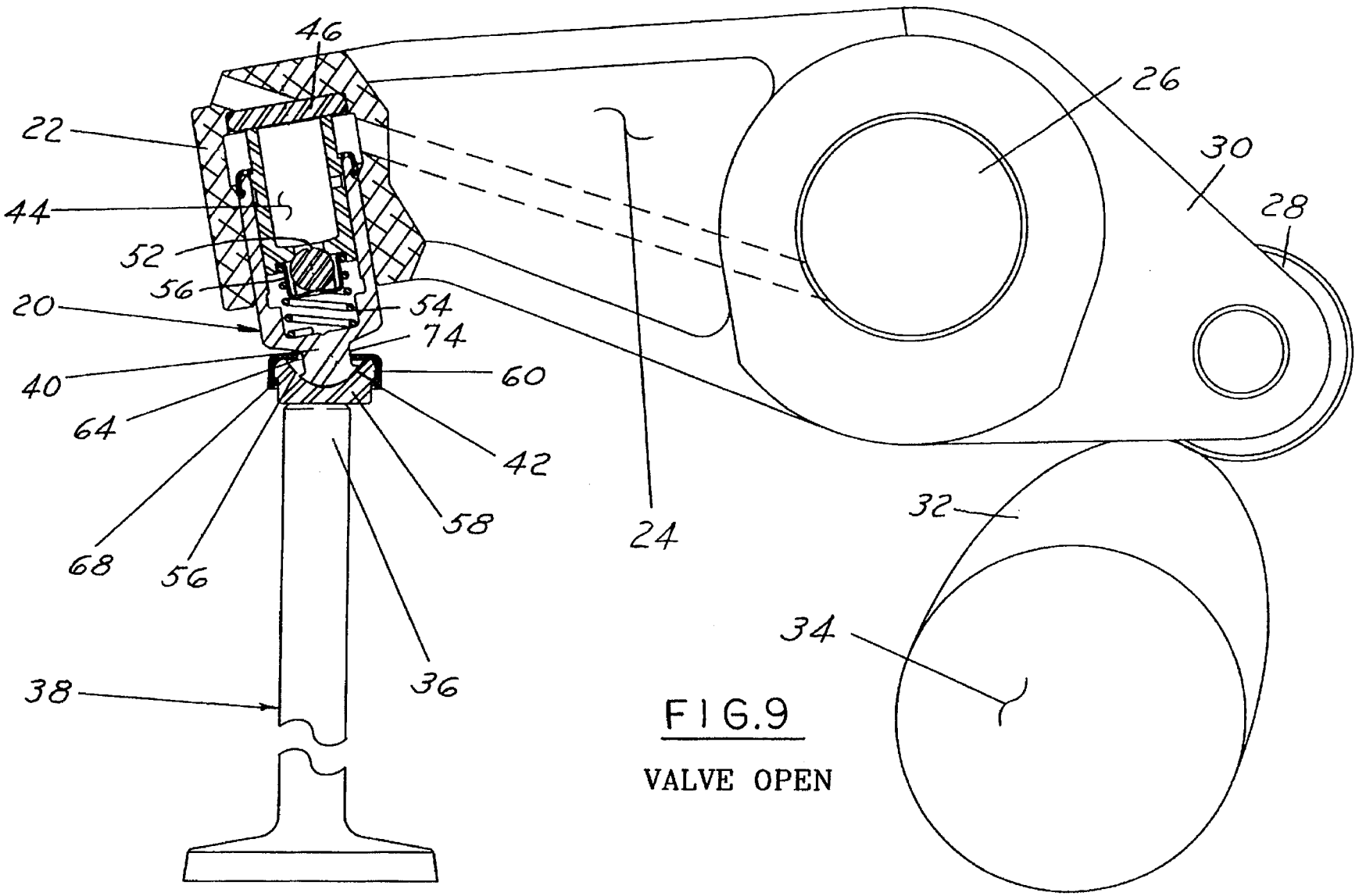
FIG. 9 is a fragmentary enlarged part sectional view of the valve form shown in FIG. 8.
Figure 10:
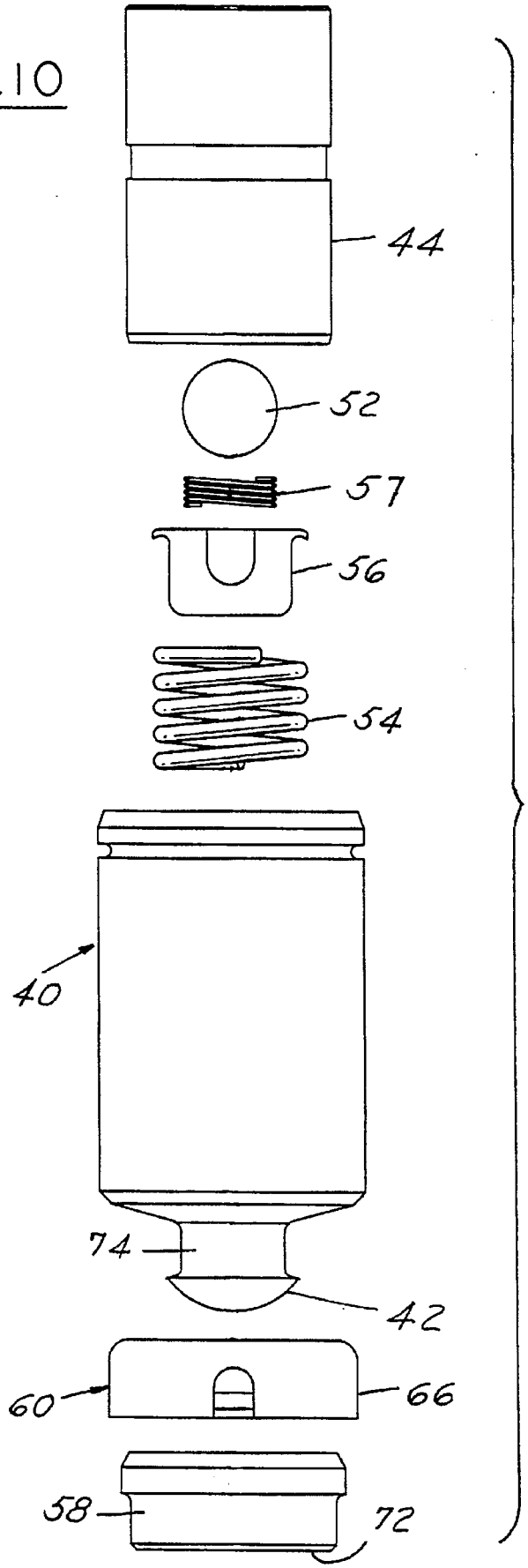
FIG. 10 is an exploded view of the lash compensating element assembly.
Figure 11:
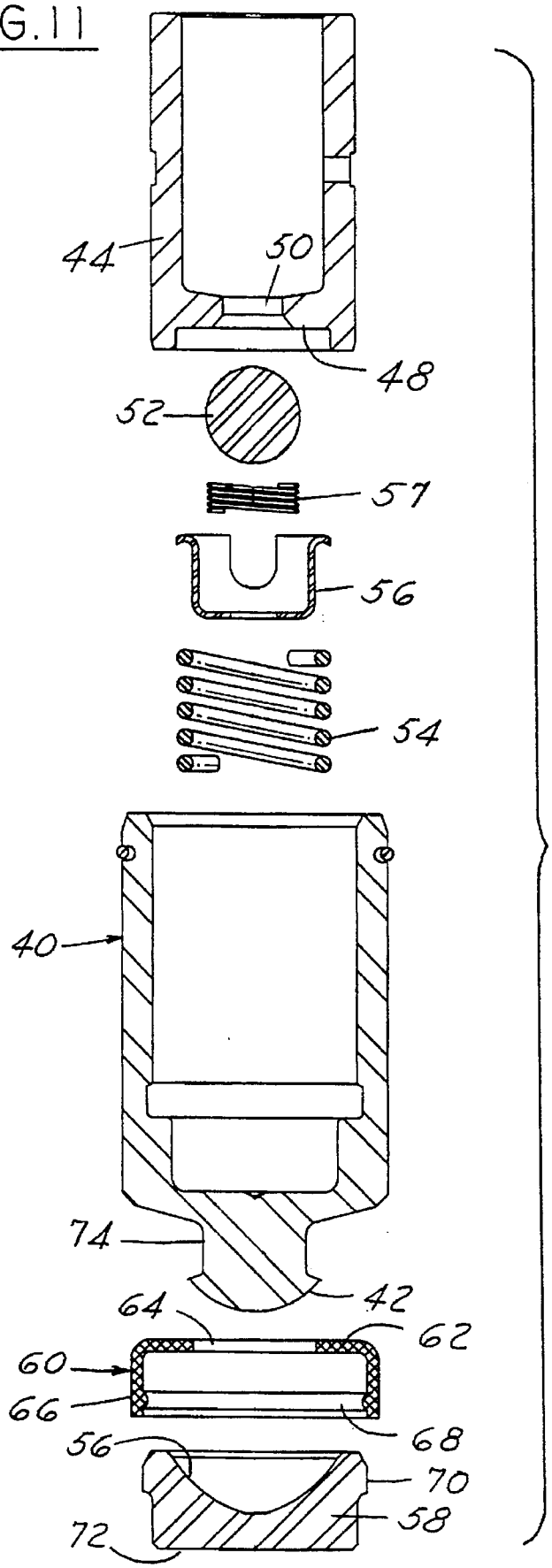
FIG. 11 is a sectional exploded view similar to FIG. 10.
Figure 13:
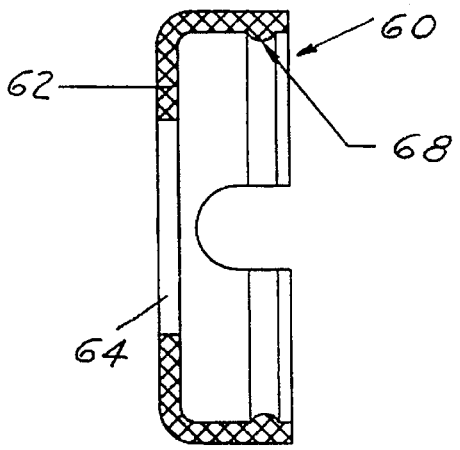
FIG. 13 is a sectional view taken along the line 13—13 in FIG. 12.
Figure 12:
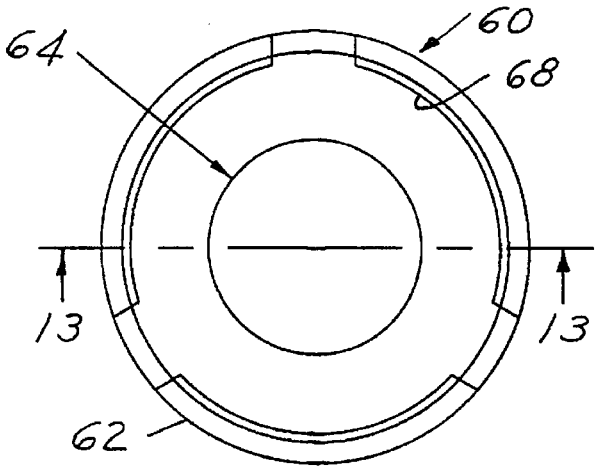
FIG. 12 is a bottom plan view of the retainer.

Referring to FIG. 6, 10, and 11, the hydraulic lash compensating element assembly 20 comprises a hydraulic base element which includes an outer housing 40 which has an open upper end and a closed lower end having an integral spherical protrusion 42 at the lower end. The assembly 20 includes an inner housing 44 slideably mounted in the outer housing 40 and engaging a wear piece 46 mounted in the rocker arm 24 (FIG. 9). The lower end of the inner housing 44 is provided with a wall 48 having an opening 50 and a ball 52 in a ball retainer 56 is yieldingly urged toward the opening by a spring 54 interposed between a ball retainer and a lower end of the outer housing 40. A light spring 57 is interposed between the ball 52 and retainer 50.

In accordance with the invention, the spherical protrusion 42 engages a spherical surface 56 on a foot 58. The foot 58 is retained on the spherical protrusion 42 by a retainer 60 which includes a base wall 62 having an opening 64 and a peripheral flange 66 projecting from the base wall 62. Flange 66 includes an annular bead 68 on the internal surface thereof. The annular bead 68 may be continuous or interrupted. The retainer 60 is telescoped over the protrusion 42 and pressed onto the foot 58 over a flange 70 permanently attaching the swivel foot 58 to the retainer 60. The foot 58 includes a flat surface 72 which engages the free end 36 of the valve stem 38.

The diameter of the opening 64 is smaller than the diameter of the spherical protrusion 42 to prevent disassembly. The diameter of the opening 64 is sufficiently larger than the diameter of the neck portion 74 to allow angular movement. As a result, there is permissible relative angular movement between the swivel foot 58 and the hydraulic lash element outer housing 40. In addition, there is permissible relative rotational motion between the swivel foot 58 and the housing 40.

Figure 15:
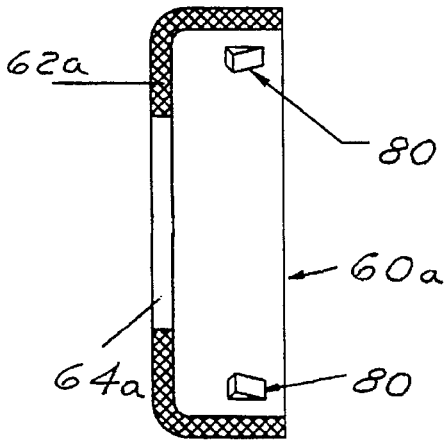
FIG. 15 is a sectional view taken along the line 15—15 in FIG. 14.
Figure 14:
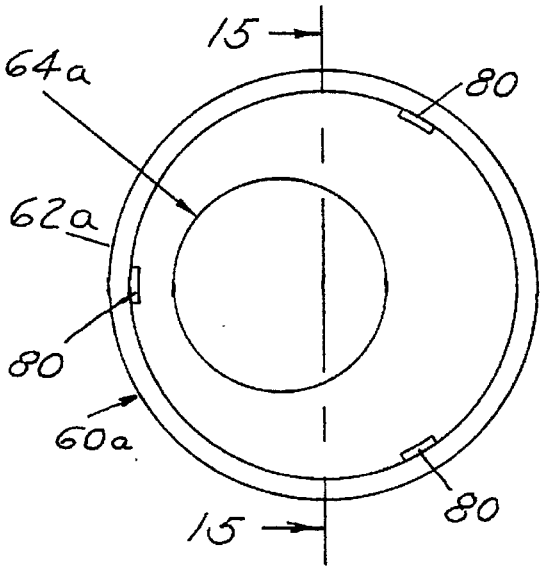
FIG. 14 is a bottom plan view of a modified form of retainer.

In the modified form of retainer shown in FIGS. 14 and 15, circumferentially spaced projections 80 are provided on the retainer 60*a* and the opening 64*a* is eccentric to the central axis of the retainer. The eccentric alternative design is used with a steel or other nonflexible retainer material. In this case, the hole 64*a* is slightly larger than the diameter of the protrusion 42. The retainer is first inserted over the protrusion 42 on the housing 40, then centered. Then it is pressed onto the swivel foot 58 preventing side to side motion. In this case, only a portion of the diameter is used to hold the foot in place.

Figure 7:
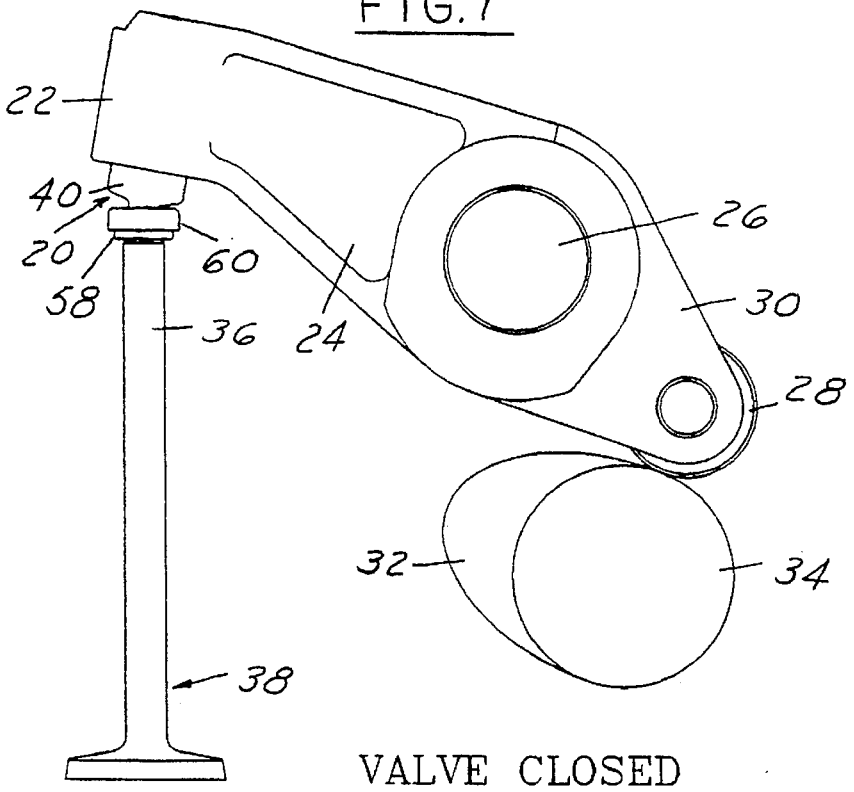
FIG. 7 is an elevational view of a valve form embodying the invention, showing the valve closed.
Figure 8:
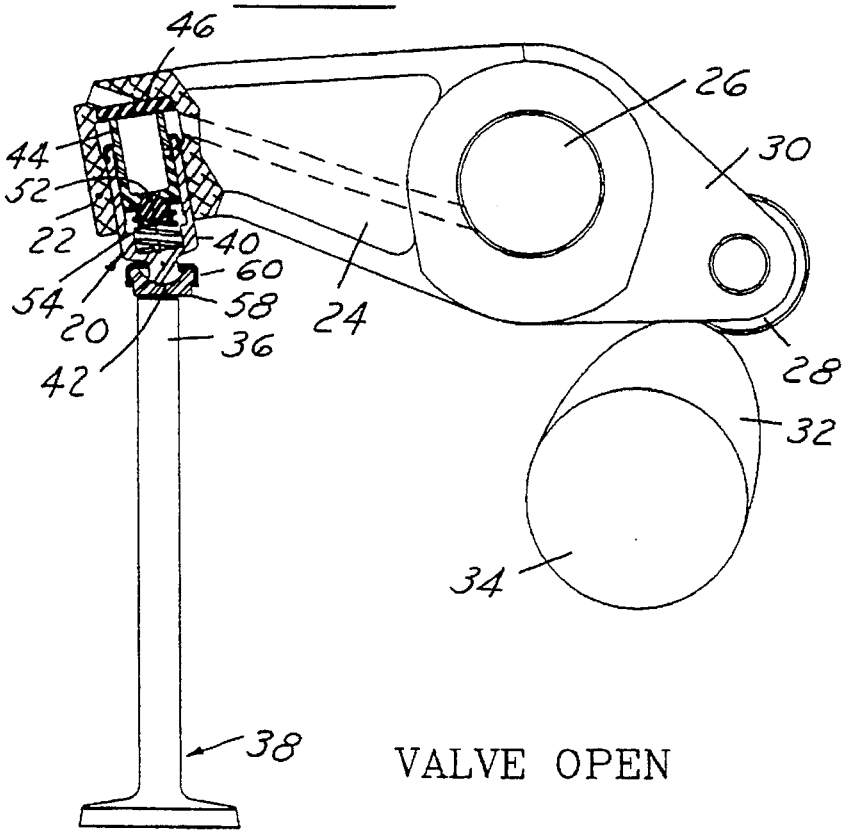
FIG. 8 is a part sectional view of the valve form shown in FIG. 7, showing the valve open.

It can thus be seen that there has been provided a hydraulic lash compensating element assembly which provides for rotational and angular movement during the valve opening and valve closing which is effective during the cam cycle (FIGS. 7–9). As a result the system minimizes wear, compensates for thermal expansion, minimizes contact stress between the lash element and the valve; minimizes the number of parts that must be maintained in inventory; minimizes machining; and contributes to longer life of the valve train.

What is claimed is:

1. A hydraulic lash compensating element assembly adapted to be interposed between a valve actuating device and a valve of an automotive engine comprising a hydraulic lash compensating element which includes an outer housing, an inner housing, spring means interposed between the outer housing and the inner housing, said outer housing having a spherical protrusion thereon at one end, said outer housing having a neck portion adjacent said enlarged spherical protrusion, a swivel foot having a generally complementary surface contacted by said spherical protrusion, and a retainer attached to said swivel foot for mounting said swivel foot on said spherical protrusion for rotational and angular movement relative to said spherical protrusion and holding said swivel foot against rotation relative to said retainer, said retainer including a base wall having an opening through which the neck portion of said outer housing extends and a flange and means for attaching said retainer and said swivel foot against relative rotation, said swivel foot having a contact surface for engaging the end of a valve.

2. The hydraulic lash compensating element assembly set forth in claim 1 wherein said means attaching said retainer and said swivel foot comprises an annular bead on said retainer, said swivel foot having a recess thereon engaged by said bead.

3. The hydraulic lash compensating element assembly set forth in claim 2 wherein said means attaching said retainer and said swivel foot comprises circumferentially spaced projections on said retainer engaging recesses on said swivel foot.

4. The hydraulic lash compensating element assembly set forth in any one of claims 1–3 wherein said opening in said base wall of said retainer is eccentric to the center of the base wall of said retainer and is larger than the diameter of the protrusion such that the retainer can first be inserted over the protrusion, then centered and attached to said swivel foot.

5. The method of making a hydraulic lash compensating element assembly adapted to be interposed between a valve actuating device and a valve of an automotive engine comprising providing a hydraulic lash compensating element which includes an outer housing, an inner housing, interposing spring means between the outer housing and the inner housing, providing a neck portion and a spherical protrusion on said outer housing, providing a swivel foot having a generally complementary surface contacted by said spherical protrusion, said swivel foot having a contact surface for engaging the end of a valve, positioning said spherical protrusion and said surfaces in engagement with said swivel foot, providing a retainer having a base wall having an opening therethrough and a peripheral flange, positioning said retainer relative to said swivel foot such that the neck portion is adjacent said opening in said base wall, and attaching said flange on the retainer to said swivel foot such that the swivel foot has rotational angular movement relative to said spherical protrusion and said swivel foot is held against rotation relative to said retainer.

6. The method set forth in claim 5 wherein said step of attaching said retainer comprises forming an annular bead on said retainer, and providing a recess on said swivel foot engaging said bead.

7. The method set forth in claim 5 wherein said step of attaching said retainer comprises forming circumferentially spaced projections, and providing recesses on said swivel foot engaging said projections.

8. The method set forth in any one of claims 5–7 including forming said opening in said base wall such that it is eccentric to the center of the base wall of said retainer and is larger than the diameter of the protrusion such that the retainer can first be inserted over the protrusion, then centered and attached to said swivel foot.

* * * * *